US005417076A

United States Patent [19]

Vaynberg

[11] Patent Number: 5,417,076

[45] Date of Patent: May 23, 1995

[54] COOLING SYSTEM AUTOMATICALLY CONFIGURABLE TO OPERATE IN CASCADE OR SINGLE COMPRESSOR MODE

[75] Inventor: Mikhail M. Vaynberg, San Francisco, Calif.

[73] Assignee: Reefco Manufacturing Corporation, Mill Valley, Calif.

[21] Appl. No.: 153,173

[22] Filed: Nov. 16, 1993

[51] Int. Cl.[6] ..... F25B 7/00

[52] U.S. Cl. ..... 62/175; 62/174; 62/335

[58] Field of Search ..... 62/175, 79, 335, 174

[56] References Cited

U.S. PATENT DOCUMENTS

| | | | |
|---|---|---|---|
| 2,968,933 | 1/1961 | Pfeifer et al. | 62/176 |
| 2,984,084 | 5/1961 | Talmey et al. | 62/239 |
| 3,386,260 | 6/1968 | Kirkpatrick | 62/239 |
| 3,572,052 | 3/1971 | Toth | 62/278 |
| 3,733,849 | 5/1973 | Cantagallo et al. | 62/414 |
| 4,691,527 | 9/1987 | Ikeda | 62/234 |
| 5,187,945 | 2/1993 | Dixon | 62/234 |

FOREIGN PATENT DOCUMENTS

| | | | |
|---|---|---|---|
| 0282744 | 9/1990 | Germany | 62/335 |

OTHER PUBLICATIONS

YORK Transportation Equipment Service and Parts Manual Model TNE 256 NL, p. 9, FIG. 3.

YORK Transportation Refrigeration and Air Conditioning Equipment Twin-Pak TNE-255 Sales Brochure.

Billy C. Langley, "Heating, Ventilating, Air Conditioning, and Refrigeration", pp. 56–58, Prentice-Hall, Inc. 1990.

Robert Chatenever, "Air Conditioning and Refrigeration for the Professional", pp. 171–174, John Wiley & Sons, Inc. 1988.

Roy J. Dossat, "Principles of Refrigeration", Third Edition, pp. 476–483, Prentice-Hall, Inc. 1991.

Andrew D. Althouse, Carl H. Turnquist, Alfred F. Bracciano, "Modern Refrigeration and Air Conditioning", The Goodheart-Willcox Company, Inc. 1992, pp. 75–99.

Coldwrap Sea Containers Inc., "The Story Of Our New Rent-A-Container Is A Lot Of Cold Air.", Sales Brochure.

"1990 Ashrae Handbook Refrigeration Systems and Applications", American Society of Heating, Refrigerating and Air Conditioning Engineers, Inc., pp. 28.1–30.16.

"Ashrae Handbook 1982 Applications", American Society of Heating, Refrigerating and Air Conditioning Engineers, Inc., pp. 43.1–45.18.

"1986 Ashrae Handbook Refrigeration Systems and Applications", American Society of Heating, Refrigerating and Air Conditioning Engineers, Inc., pp. 28.1–30.18.

Thermo King Sales Brochure for Models SB-III & SB-III MAX.

*Primary Examiner*—William E. Wayner

*Attorney, Agent, or Firm*—Haverstock, Medlen & Carroll

[57] ABSTRACT

A broad range cooling system is provided which can operate to cool a product load to a predetermined temperature in the range of −25° F. to +75° F. over an ambient temperature range of −60° F. to 150° F. The system includes two compressor systems which are configurable to operate independently as single compressor cooling systems each having a unique cooling range, or together as a cascade system, depending upon the desired temperature requirements of the load and the ambient. In the event of a failure of one or the other compressor, the system is configured to continue operation with the other compressor as a single compressor system until a repair can be affected.

10 Claims, 2 Drawing Sheets

COOLING SYSTEM AUTOMATICALLY CONFIGURABLE TO OPERATE IN CASCADE OR SINGLE COMPRESSOR MODE

FIELD OF THE INVENTION

This invention relates to the field of cooling systems. More particularly, this invention relates to the field of cascade refrigeration systems.

BACKGROUND OF THE INVENTION

Single compressor systems are well known for cooling. Such systems are commonly used in refrigerated containers for trucks, rail and shipboard transportation of food products. Note however, that the present invention is not restricted to transportation applications of refrigerated container.

Single compressor containers are unequal to certain cooling tasks. For example, once produce is picked it is desirable to immediately reduce its temperature to prevent spoiling. During hot summer months, shippers of produce transport the produce to a cold storage warehouse to bring the produce down to temperature before loading onto a refrigerated container which merely operates to maintain the temperature of the precooled produce are incapable of bringing the produce to adequate temperature quickly enough. The ability of such transportation devices to cool a hot load of produce in a sufficiently short time to prevent spoilage does not exist in commercially-available containers.

Most commercially-available refrigerated containers for transportation are single compressor systems. Generally, single compressor systems are inadequate for cooling a load below about −20° F. Some commercially-available refrigerated containers having single compressor systems can cool a load to about 0° F. Unfortunately, purchasers of refrigerated containers desire a device which can maintain a load at −20° F. and lower at ambient temperatures up to +150° F.

By way of example, consider a single compressor system for cooling a load to −20° F. in an ambient environment of +150° F. The evaporator temperature necessary to maintain the load at a predetermined temperature is at the best 10° F. colder than the load. Here the evaporator is cooled to −30° F. Under these conditions using R12, the evaporator pressure is expected to be approximately 9 psi and using R22, the expected pressure is approximately 20 psi. Similarly, the condenser temperature necessary to discharge heat to the ambient is 10° to 40° warmer than the ambient under the best case conditions; thus, in this example, the condenser is at 160° F. The pressure in the condenser under these conditions is expected to be approximately 278 psi for R12 and 445 psi for R22.

The conditions in the example of the previous paragraph dictate a compression ratio of $278/9 \approx 31$ for R12 and $445/20 \approx 22$ for R22. Refrigeration compressors are designed and built to operate with a compression ratio no greater than 15. If the pressure ratio exceeds the manufacturer's design criteria the compressor will break. Accordingly, neither example above could be achieved with a conventional single compressor system. Indeed, a commercially available compressor is not available with the capacity to operate in a refrigerated container environment under the above conditions and accordingly, such a system in a refrigerated container would be prohibitively expensive and inefficient. Thus, commercially available single compressor systems are incapable of operating where the difference between the desired product temperature and the actual ambient temperature is very large as in these examples.

Cascade systems are well known. It is well understood in cascade systems that heat from a lower cascade condenser is removed by the evaporator of a high cascade compressor system; and heat from the high cascade system is dissipated into the ambient. The pressure ratio for the cascade system is the product of the pressure ratio for both the low cascade compressor system and the high cascade compressor system. A cascade system for the R22 example described above would also have a pressure ratio of approximately 22 and it could have both the low and high compressor systems operating at the same pressure ratios, i.e., both pressure ratios at approximately 4.7 for each compressor. This pressure ratio is well within an acceptable range of the specifications of commercially available compressors.

Cooling systems require a minimum pressure ratio to operate. If the necessary pressure ratio becomes too small the compressor will fail. As the difference between the product temperature and the ambient temperature is reduced, the pressure ratio for a cooling system is also reduced. When using a cascade cooling system, as the difference between these temperatures becomes smaller, the pressure ratio for both compressor systems will fall below the minimum pressure ratio necessary for operation sooner than a system using a single compressor.

Conventional cascade systems use different refrigerants, one for each compressor in each system. This requires the system designer to uniquely design the low compressor system and the high compressor system. Commonly used refrigerants are 502 and R12. To protect the environment, these refrigerants will be banned after 1995. The refrigerant R22 is far less damaging to the environment than 502 or R12 and as such is not scheduled to be banned until 2020.

What is needed is a cooling system for cooling a load of product to a desired temperature which can efficiently operate over a broad range of ambient temperatures, e.g., −60° F. to +150° F. and load temperatures from −25° F. to +75° F.

SUMMARY OF THE INVENTION

A broad temperature range cooling system is provided which can operate over a load temperature range of −25° F. to 75° F. and an ambient temperature range from −60° F. to +150° F. The system includes two compressor systems which are also configurable to operate independently as single compressor cooling systems, or together as a cascade system, depending upon the desired temperature requirements of the load and the given ambient. In the event of a failure of one or the other compressor, the system is configured to continue operation with the other compressor as a single compressor system until a repair can be affected.

DETAILED DESCRIPTION OF THE PREFERRED EMBODIMENT

Figure 1A:
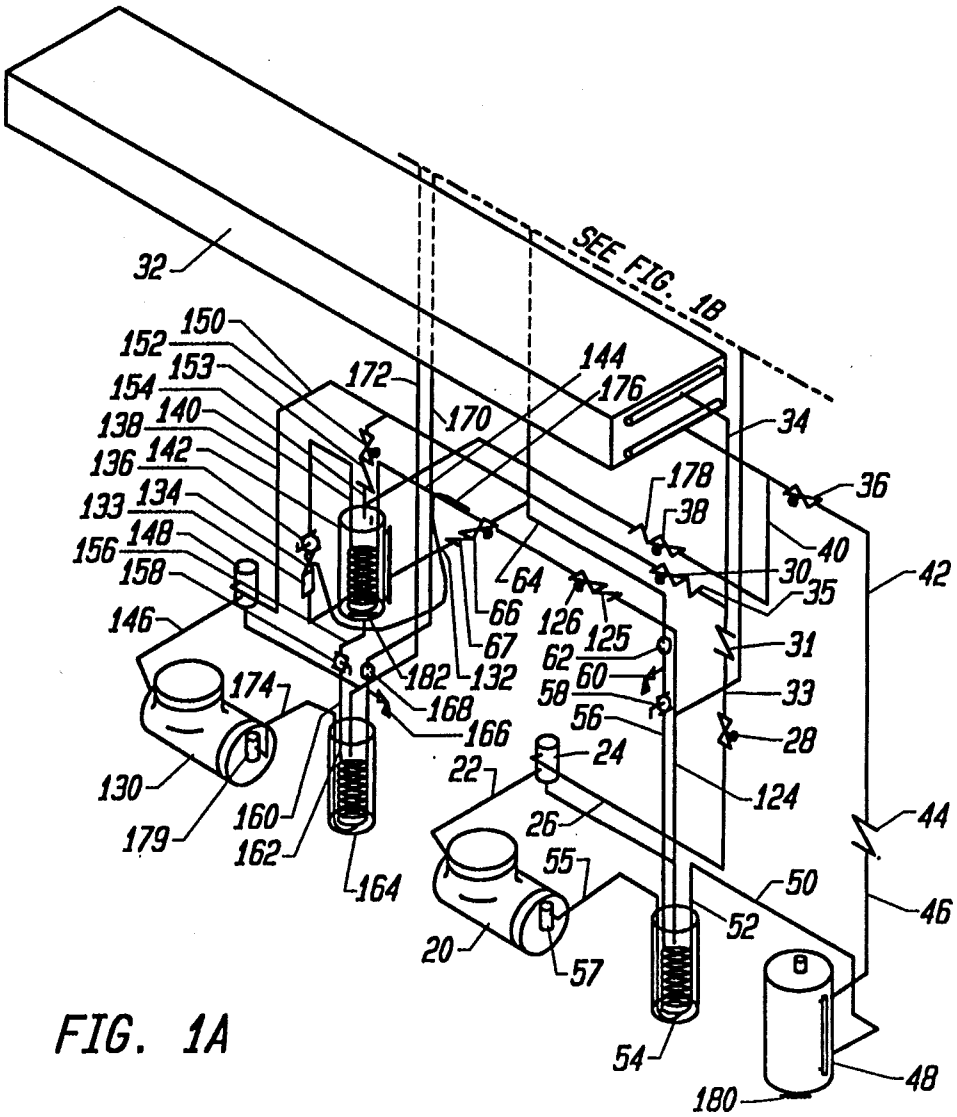
FIG. 1 shows a perspective view of a schematic diagram of the configurable cooling system of the present invention.

The cooling system of the preferred embodiment of the present invention is configured to operate as two single compressor systems, each one operating at a time, or as cascade cooling system. If the difference between the desired temperature of the product and the ambient temperature is sufficiently small, the apparatus according to the present invention can automatically configure the system to operate the smaller or the bigger one of the two compressor systems. The two compressor systems preferably have different compressor capacity to provide an even broader range of cooling control. Either compressor can be used in the single compressor mode. The difference is deemed sufficiently small if the pressure ratio would be too small to operate effectively if the system were configured in cascade mode.

If the difference between the set temperature of the product and the ambient temperature is sufficiently large, the apparatus can automatically configure the system to operate in the cascade mode. The difference is deemed large if the pressure ratio when operating in single compressor mode would exceed the acceptable specifications. Because either compressor can be configured to provide liquid to the evaporators, and because each compressor has its own supply of refrigerant, the system includes means for draining the refrigerant from the evaporators prior to releasing control of the evaporator.

In the event that the system is operating as a single cooling system using only the compressor 20, the compressor 20 compresses the gas into the hot gas line 22 which is applied to the oil separator 24. Up to 98% of the oil that is present in the compressed gas is separated from the gas in the oil separator 24, and the gas is applied to the hot gas line 26. The hot gas line 26 is coupled to a hot gas solenoid 28 which is open. The hot gas solenoid 28 is coupled to check valve 31 via a hot gas pipe 33. The check valve 31 is coupled to a check valve 35 and to a condenser 32 via a hot gas "Y" pipe 34. The check valve 35 is coupled to a hot gas solenoid 30 which is closed. For the purposes of this specification, a "Y" pipe is defined as a pipe that is plumbed to couple more than two elements on the cooling circuit to one another.

The hot gas gives up heat to the air and condenses to a liquid in the condenser 32. The output of the condenser is coupled to two liquid solenoids, 36 and 38, via the liquid "Y" pipe 40. The liquid solenoid 38 is closed, and the liquid passes through liquid solenoid 36 into the liquid pipe 42 to a check valve 44. A liquid pipe 46 is coupled between the output of the check valve 44 and the input of a linear receiver 48.

The output of the linear receiver 48 is coupled to the input of a coil 52 of a suction accumulator 54 via a liquid pipe 50. The output of the coil 52 of the suction accumulator 54 is coupled to a liquid pipe 56, which is coupled in turn to a ball valve 58. The output of the ball valve is coupled to a charge valve 60 which in turn is coupled to a sighting glass 62. The output of the sighting glass 62 is coupled to a liquid "Y" pipe 64, which in turn is coupled to two liquid solenoids 66 and 68.

In the single compressor mode, the liquid solenoid 66 is closed, and the solenoid 68 is open. The output of the liquid solenoid 68 is coupled to a check valve 69 which in turn is coupled to a liquid "Y" pipe 72, which in turn is coupled to a check valve 74, and two filter/dryers 76 and 78. The check valve 74 is coupled to a solenoid 106. The filter/dryer 76 is coupled to a thermostatically controlled thermal expansion valve 80 and the filter/dryer 78 is coupled to a thermostatically controlled thermal expansion valve 82.

The output of the thermal expansion valve 80 is coupled to a liquid "Y" pipe 84, which in turn is coupled to a ball valve 86 and a solenoid 92 which is closed. The output of the ball valve 86 is coupled to a "Y" pipe 88, which in turn is coupled to a plurality of evaporators 90. Similarly, the output of the thermal expansion valve 82 is coupled to a "Y" pipe 96, which in turn is coupled to a ball valve 98 and to a liquid solenoid 100. The output of the ball valve 98 is coupled to a liquid pipe 102, which in turn is coupled to a plurality of evaporators 104. In the single compressor operating mode, the liquid solenoids 74, 92, 100 and 106 are closed.

The liquid in the evaporators 90 absorbs heat wherein it evaporates to a cold gas which returns via the cold gas "Y" pipe 108. The cold gas "Y" pipe 108 is coupled to the cold gas solenoid 110 which is closed, to the cold gas solenoid 118 which is open and to the evaporators 104. A thermostatic bulb 112 of the thermal expansion valve 80 is mounted on the cold gas pipe 108. Similarly, the liquid applied to the evaporators 104 by the liquid pipe 102 evaporates to a cold gas which is coupled to the cold gas solenoid 118 and 110. A thermostatic bulb 120 of the thermal expansion valve 82 is also mounted on the cold gas pipe 108.

For this single compressor operation, the cold gas solenoid 110 is closed. The cold gas solenoid 118 is coupled to a check valve 122 which in turn is coupled to a "Y" pipe 124. The "Y" pipe 124 is coupled to the check valves 93 and 125 and to the shell of the suction accumulator 54. The check valve 125 is coupled to the cold gas solenoid 126 which is closed so the gas returns through the shell of the suction accumulator 54 to the cold gas pipe 55, to the suction dryer 57 and finally to the compressor 20 where the cycle is complete.

Figures 1B, 1C:
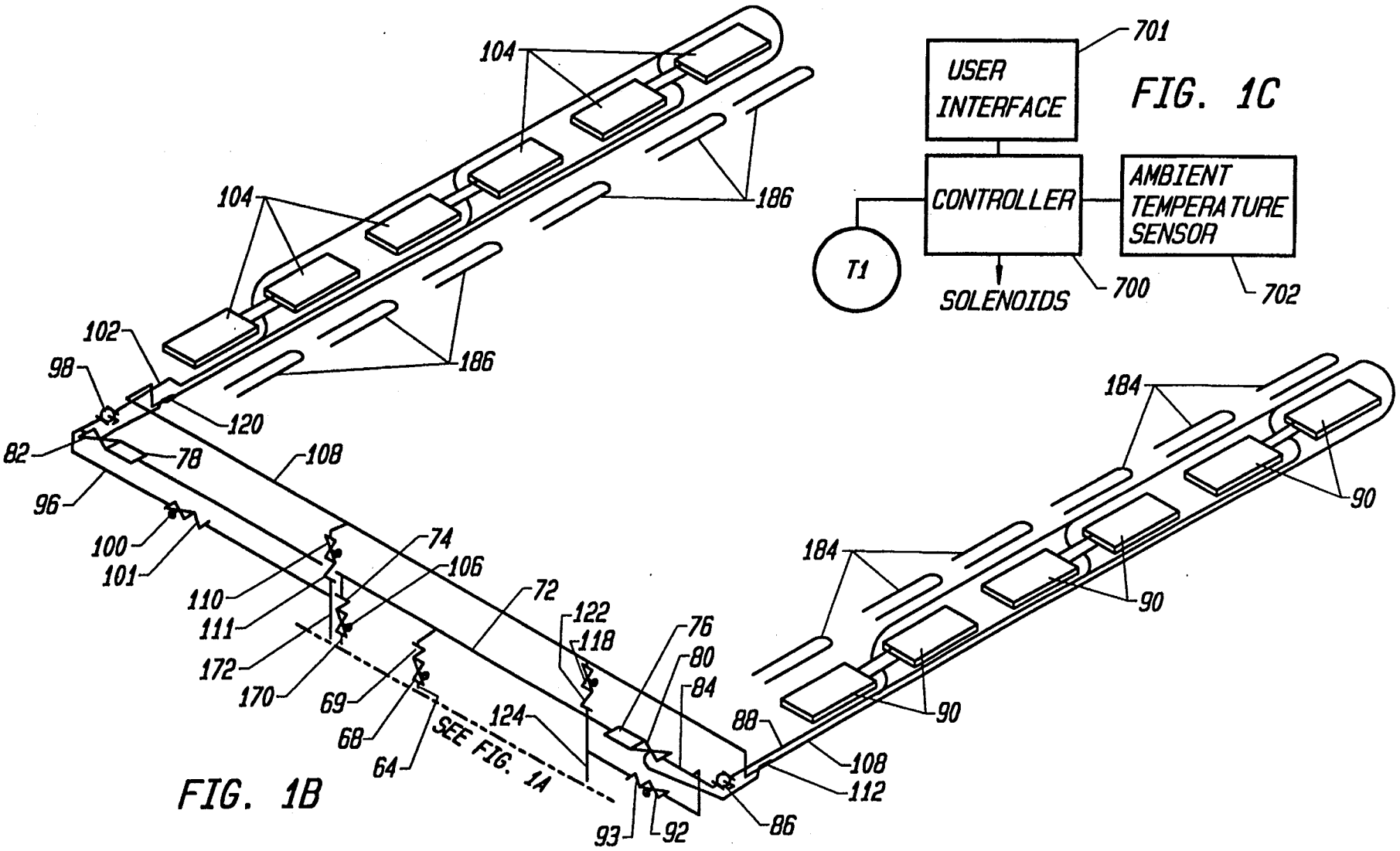

The cooling system, according to FIG. 1, is set up for a refrigerated container having multiple evaporators. Accordingly, two sets of evaporator coils 90 and 104 are utilized in the preferred embodiment. It will be apparent to one of ordinary skill in the art that the evaporator coils 104, as well as the liquid solenoid 100, the filter dryer 78, the thermal expansion valve 82, the ball valve 98, the thermostatic bulb 120 and the associated piping can all be eliminated to provide a single evaporator system which can be used as in conventional refrigerated cooling systems.

In order to perform the cascade cooling operation, two compressor systems are provided. Each compressor has its own refrigerant. Preferably both refrigerants are of the same type. Thus, during a switch from a one compressor to a two compressor operation, the refrigerant and the oil from the first compressor system first needs to be removed from the evaporators 90 and 104 so that the refrigerant from a second compressor 130 can be used in the evaporators. This avoids the situation where one of the systems has too much refrigerant and oil and the other too little. The cascade cooling system according to the present invention is designed to use R22 refrigerant in each of the two compressors 20 and 130.

To remove the refrigerant from the evaporators after the system has operated in a single compressor mode using only compressor 20, the liquid solenoid 68 and cold gas solenoid 118 are closed. The remainder of the solenoids stay in their previous condition as described above. While the compressor 20 still operates, the liquid drain solenoid 92 is opened and the heaters 184 and 186 are energized. The heat from the heaters 184 and 186 boils the refrigerant and oil from the evaporators. The compressor continues to run until a low pressure switch cuts out the compressor which removes essentially all the refrigerant and oil from the system.

Once the evaporators 90 and 104 are cleared of refrigerant and oil, the cooling circuit for the compressor 20 is then conditioned to operate as follows. Hot gas is discharged from the compressor 20 through the hot gas line 22 into the oil separator 24. The hot gas leaves the oil separator 24 via the hot gas line 26 and then through the hot gas solenoid 28. The hot gas is coupled through the hot gas solenoid 28 to the hot gas pipe 33 to the check valve 31. Then, the hot gas is coupled to the hot gas "Y" pipe 34, which in turn is coupled to the hot gas solenoid 30 which is closed through the check valve 35, and to the condenser 32. The gas gives up heat to the air and is converted to a liquid in the condenser 32.

The output of the condenser 32 is coupled to the liquid "Y" pipe 40, which in turn is coupled to the liquid solenoids 36 and 38. The liquid solenoid 38 is closed, and the liquid from the condenser 32 passes through the liquid solenoid 36 into the liquid pipe 42. The liquid then passes through the check valve 44 into the liquid pipe 46, which is coupled to provide the liquid to the linear receiver 48. The liquid passes from the linear receiver 48 into the liquid pipe 50 and into the coil 52 of the suction accumulator 54. The liquid leaves the coil 52 of the suction accumulator 54 through the liquid pipe 56 and passes through the ball valve 58 and the sighting glass 62. A charge valve 60 is coupled to the pipe between the ball valve 58 and the sighting glass 62. The liquid is coupled to the liquid "Y" pipe 64. The solenoid 68 remains closed and the solenoid 66 is opened so that the liquid passes through the solenoid 66, the check valve 67 and into the liquid pipe 132. The liquid is coupled to a filter/dryer 133 which is coupled to a thermostatically controlled thermal expansion valve 134. The liquid passes through the thermal expansion valve 134, through a ball valve 136 and into the liquid pipe 138.

The liquid pipe 138 is coupled to provide the liquid to the coil 140 of a heat exchanger 142. The heat exchanger 142 contains an evaporator for the liquid which evaporates thereby forming a cold gas within the coil 140. The cold gas is coupled to a cold gas pipe 144, which passes through the now opened cold gas solenoid 126, the check valve 125 and into the cold gas pipe 124. The cold gas solenoid 118 and liquid drain solenoid 92 are closed so the cold gas passes through the shell of the suction accumulator 54, into the cold gas pipe 55, to the suction filter 57 and from there into the compressor 20.

At the same time the compressor 130 compresses a gas forming a hot gas which is discharged through a hot gas pipe 146 into an oil separator 148. The separated hot gas is discharged from the oil separator 148 into the hot gas "Y" pipe 150. The hot gas "Y" pipe 150 is coupled to the hot gas solenoid 30 and a hot gas solenoid 152. The hot gas solenoid 30 is closed, and the hot gas solenoid 152 is opened, which couples the hot gas through a check valve 153, the hot gas pipe 154, and into the shell of the heat exchanger 142.

Because the heat exchanger 142 contains an evaporator for the circuit of compressor 20 and condenser for the circuit with the compressor 130, the hot gas is cooled by the high cascade compressor 20 circuit to a liquid within the heat exchanger 142. The liquid exits the heat exchanger 142 via a liquid pipe 156, and passes through the ball valve 158. The liquid leaves the ball valve 158 through the liquid pipe 160 into the coil 162 of a suction accumulator 164. The output of the coil 162 of the suction accumulator 164 passes through a sighting glass 168 and into the liquid "Y" pipe 170. A charge valve 166 is coupled to the pipe between the suction accumulator 164 and the sighting glass 168.

The liquid "Y" pipe 170 is coupled to the liquid solenoid 106. The output of the liquid solenoid 106 is coupled to the check valve 74 and then to the liquid "Y" pipe 72. The liquid solenoid 68 is closed so the liquid passes through the filter/dryers 76 and 78, the thermal expansion valves 80 and 82, into the liquid pipe 84 and 96, respectively. The liquid solenoid 92 is closed so the liquid in the pipe 84 passes through the ball valve 86 to the liquid "Y" pipe 88, the evaporators 90 and returns as a cold gas through the cold gas "Y" pipe 108. Similarly, the liquid solenoid 100 is closed so the liquid in the pipe 96 passes through the ball valve 98 to the liquid "Y" pipe 102, the evaporators 104 and returns as a cold gas through the cold gas "Y" pipe 108.

The cold gas solenoid 118 is closed so the cold gas passes through the open cold gas solenoid 110 and the check valve 111 into the cold gas "Y" pipe 172. The cold gas passes from the "Y" pipe 172 into the shell of the suction accumulator 164 and out through the cold gas pipe 174 into the suction filter 178 and back into the compressor 130. A thermostatic bulb 176 of the thermal expansion valve 134 is mounted on the pipe 144.

Operating in this cascade mode, the cooling system of the figure is capable of producing temperatures as cold as −25° F. even when the ambient temperature is as high as 150° F. This is because the hot gas in the cooling system of the compressor 130 is cooled in the heat exchanger 142 which contains an evaporator for the cooling system of the compressor 20. Thus, neither compressor need operate at pressure ratios in excess of the manufacturer's specification in order to achieve the necessary cooling.

The system can also operate under a single compressor mode using only the compressor 130. Here, because the refrigerant in the evaporators 90 and 108 is already the refrigerant for the compressor 130, there is no need to clear the refrigerant and oil from the evaporators.

In a single compressor mode of operation using the compressor 130, the hot gas is pumped by the compressor 130 through the hot gas pipe 146 into the oil separator 148. The hot gas leaves the oil separator via the hot gas "Y" pipe 150. The hot gas solenoid 152 is closed, and the hot gas solenoid 30 is open, so the hot gas passes through the hot gas solenoid 30, the check valve 35 and into the hot gas "Y" pipe 34. The hot gas solenoid 28 is closed, so the hot gas passes through the condenser 32 where it gives up heat to become a liquid and then leaves the condenser 32 via the liquid "Y" pipe 40.

The liquid solenoid 36 is closed, and the liquid solenoid 38 is open. The liquid passes through the liquid solenoid 38 through the check valve 178 into the hot gas pipe "Y" 154 and into the shell of the heat exchanger 142 which serves as a linear receiver in this mode. The liquid passes out of the heat exchanger 142 (receiver) into the liquid pipe 156 through the ball valve 158 and through the liquid pipe 160 into the coil 162 of the suction accumulator 164. The liquid leaves the coil 162 of the suction accumulator 164, passing by the charge valve 166 through the sighting glass 168, and into the liquid "Y" pipe 170.

The liquid passes through the liquid solenoid 106, the check valve 74 and into the liquid "Y" pipe 72. The liquid solenoid 68 is closed so the liquid passes through the filter/dryers 76 and 78, the thermal expansion valves 80 and 82, into the liquid pipes 84 and 96, respectively. The liquid solenoid 92 is closed so the liquid in the pipe 84 passes through the ball valve 86 to the liquid "Y" pipe 88, the evaporators 90 and returns as a cold gas through the cold gas "Y" pipe 108. Similarly, the liquid solenoid 100 is closed so the liquid in the pipe 96 passes through the ball valve 98 to the liquid "Y" pipe 102, the evaporators 104 and returns as a cold gas through the cold gas "Y" pipe 108.

The cold gas solenoid 118 is closed so the cold gas passes through the open cold gas solenoid 110 and the check valve 111 into the cold gas "Y" pipe 172. The cold gas passes from the "Y" pipe 172 into the shell of the suction accumulator 164 and out through the cold gas pipe 174 into the suction filter 178 and back into the compressor 130. A thermostatic bulb 176 of the thermal expansion valve 134 is mounted on the pipe 144.

For circumstances where the system changes from a cascade operation as described above or from a single compressor operation using the compressor 130 to a single compressor operation using the compressor 20, the refrigerant and oil must be cleared from the evaporators before the compressor 20 can supply the evaporators with refrigerant. The liquid solenoid 106 and cold-gas solenoid 110 are closed. The remainder of the solenoids stay in their previous condition as described above. While the compressor 130 still operates, the liquid drain solenoid 100 is opened and the heaters 184 and 196 are energized. The heat from the heaters 184 and 186 boils the refrigerant and oil from the evaporators. The compressor continues to run until a low pressure switch cuts out the compressor which removes essentially all the refrigerant and oil from the system.

In certain cold climate conditions, the ambient temperature surrounding the cooling container is low enough that an insufficient pressure differential exists for the thermal expansion valves to open and feed the liquid refrigerant into the evaporators so that the cooling system will not operate. For such conditions of operation, the heaters 180 and 182 are provided in the base of the receiver and heat exchanger. The appropriate one of the heaters 180 or 182 will operate depending upon which compressor is configured to operate. The heaters are used to heat the liquid to a level for providing sufficient pressure differential to allow the system to start normally. Then the heaters are turned off automatically. In this way, such a container can be used from the hottest to the coldest climates.

Additional heaters 184 and 186 are provided to assist in defrosting of the evaporators 90 and 104, respectively. Under certain cold ambient temperatures, these heaters 184 and 186 can be used to maintain the product temperature higher than the ambient.

Preferably, the solenoids are automatically controlled by an electronic control system as illustrated in FIG. 1. The controller 700 is coupled to the temperature sensor T1 for determining the temperature of the product in the container. The controller 700 is further coupled to the ambient temperature sensor 702 for determining the temperature outside of the container. The controller 700 is also coupled to a user-interface 701 for communicating with a user of the system. The controller 700 is further coupled to the solenoids for controlling the operation of the solenoids. In the preferred embodiment, the controller is a microprocessor. Temperature sensors T1 and 702 regulate whether one or the other compressor operates, or both compressors operate as a cascade system depending upon the desired temperature of the load in relation to the ambient temperature.

In operation, the user enters the desired temperature into the controller 700 through the user interface 701. Via its sensors T1 and 702, the controller 700 senses the ambient temperature and the set load temperature. The controller 700 calculates a difference value between the desired load temperature and the ambient temperature and if beyond a preset threshold, automatically configures the system to operate in cascade mode. Otherwise, it configures the system to operate in single compressor mode using the compressor 20 or 130. If the system determines that one of the compressors is non-functional, it can automatically switch to operation as a single compressor system using the other compressor.

What is claimed is:

1. A cooling system for cooling a product load to a predetermined temperature over a wide range of ambient temperatures comprising:

a. a first compressor for compressing a first supply of refrigerant, the first compressor coupled to a primary condenser, an expansion valve and a primary evaporator;

b. a second compressor for compressing a second supply of refrigerant, the second compressor coupled to the primary condenser, the expansion valve and the primary evaporator;

c. a heat exchanger containing a secondary condensor coupled to the first compressor and a secondary evaporator coupled to the second compressor;

d. means for selectively operating the first compressor, the second compressor, or both, configured as a cascade system;

e. means for clearing substantially all of the first supply of refrigerant from the primary evaporator into the first compressor; and f. means for clearing substantially all of the second supply of refrigerant from the primary evaporator into the second compressor.

2. The cooling system according to claim 1 wherein both the first supply of refrigerant and the second supply of refrigerant are the same type of refrigerant.

3. The cooling system according to claim 1 further comprising an automatic controller for automatically configuring the system.

4. The cooling system according to claim 3 further comprising:

a. means for entering a desired temperature to the controller;

b. a first temperature sensor coupled to provide temperature data to the controller for sensing an ambient temperature; and c. a second temperature sensor coupled to provide temperature data to the controller for sensing a temperature of a load.

5. The cooling system according to claim 3 further comprising a plurality of solenoids coupled for control by the controller for automatically configuring the system.

6. A cooling system comprising:

a. a first compressor for compressing a first supply of refrigerant into a first supply of hot gas;

b. a first heat exchanger having a first condenser side and a first evaporator side;

c. a primary evaporator;

d. a second compressor for compressing a second supply of refrigerant into a second supply of hot gas;

e. a condenser;

f. means for selectively coupling the cooling system into any one of at least three configurations including:

(1) a first single compressor system wherein the first compressor is coupled to provide the first supply of hot gas to the condenser for forming a first supply of liquid which is coupled to the primary evaporator for forming a first supply of cold gas which is returned to the first compressor;

(2) a second single compressor system wherein the second compressor is coupled to provide the second supply of hot gas to the condenser for forming a second supply of liquid which is coupled to the primary evaporator for forming a second supply of cold gas which is returned to the second compressor;

(3) a cascade compressor system wherein the first compressor is coupled to provide the first supply of hot gas to the condenser side of the heat exchanger for forming a third supply of liquid, the third supply of liquid is coupled to the primary evaporator for forming a third supply of a cold gas which is returned to the first compressor, the second compressor is coupled to provide the second supply of hot gas to the condenser for forming a fourth supply of liquid, the fourth supply of liquid is coupled to the evaporator side of the heat exchanger for forming a fourth supply of cold gas which is returned to the second compressor; and g. means for clearing substantially all first supply refrigerant from the evaporator into the first compressor and means for clearing substantially all second supply refrigerant from the evaporator into the second compressor.

7. The cooling system according to claim 6 wherein both compressors use the same type of refrigerant.

8. The cooling system according to claim 6 further comprising an automatic controller for automatically configuring the system.

9. The cooling system according to claim 8 further comprising:

a. means for entering a desired temperature to the controller;

b. a first temperature sensor coupled to provide temperature data to the controller for sensing an ambient temperature; and c. a second temperature sensor coupled to provide temperature data to the controller for sensing a temperature of a load.

10. The cooling system according to claim 8 further comprising a plurality of solenoids coupled for control by the controller for automatically configuring the system.

* * * * *